US005383296A

United States Patent [19]

Vecchione et al.

[11] Patent Number: 5,383,296

[45] Date of Patent: Jan. 24, 1995

[54] FLEXIBLE DISPLAY BANNER

[76] Inventors: Elizabeth J. Vecchione; J. Vecchione, Jr., both of 4010 Stella Ct., Richmond, Va. 23234

[21] Appl. No.: 995,065

[22] Filed: Dec. 22, 1992

[51] Int. Cl.[6] ..... G09F 17/00

[52] U.S. Cl. ..... 40/604; 40/612

[58] Field of Search ..... 40/603, 604, 612; 47/22, 23, 24, 24 T; 405/211, 211.1, 212, 216

[56] References Cited

U.S. PATENT DOCUMENTS

| | | | |
|---|---|---|---|
| 1,282,677 | 10/1918 | Comstock | 47/22 |
| 3,089,268 | 5/1963 | Frey et al. | 40/604 |
| 4,596,106 | 6/1986 | Kunczynski | 47/23 X |
| 4,764,054 | 8/1988 | Sutton | 405/216 |
| 5,016,388 | 5/1991 | Burress et al. | 47/23 |

FOREIGN PATENT DOCUMENTS

| | | | |
|---|---|---|---|
| 313499 | 4/1989 | European Pat. Off. | 40/603 |

*Primary Examiner*—Peter R. Brown
*Assistant Examiner*—J. Bonifanti
*Attorney, Agent, or Firm*—Norman B. Rainer

[57] ABSTRACT

A flexible display banner functions to display visually perceived messages, of a changing nature, particularly a light emitting diode message display signboard and messages of an unchanging nature whereas the said messages are a physical part of said banner.

The flexible display banner includes a containment pouch having four opaque panels and one transparent panel which houses said message signboard, which projects a plurality of messages which can be readily changed including many by remote control. The containment pouch also houses an alarm, particularly one sounding like a fire alarm, which will be activated by unauthorized tampering.

10 Claims, 3 Drawing Sheets

FLEXIBLE DISPLAY BANNER

FIELD OF THE INVENTION

This invention relates generally to message projections, particularly regarding warnings of unsafe conditions and also of an informative and instructional nature, including messages of a personal, novel, commercial and advertisement nature. Some of the most commonly used methods of message projections of this nature are cones, blockade barriers, flag-type tripod assemblies and hanging-type banners, generally placed in the vicinity of the areas they may pertain to, thereby alerting people to unsafe conditions, roadwork, construction work; messages of a personal and novel nature, such as promoting one's favorite sport team, the birth of a child, holiday and seasonal messages or adornments; messages of a commercial and advertisement nature, such as concerts, sporting events, sales promotions, corporate indicia, and other like promotions, such as scholastic and collegiate events, fraternity and sorrority indicia and functions or messages of any nature.

BACKGROUND OF THE INVENTION

Many commonly used practices of message projections relating to unsafe conditions or hazards are cones, blockade barriers, flags, tripod assemblies, hanging banners, which are either cumbersome, heavy, bulky, difficult to store and transport, flimsy, and adversely affected by inclement weather conditions, particularly being tattered, torn and dislocated by winds of high velocity. The most commonly used practices of message projections of a personal and novel nature are hanging banners, posters and banners attached to structures, A-frame signs, and hand-made signs and posters which also are adversely affected by said weather conditions. The most commonly used practices of messages projections relating to a commercial and advertisement nature are all forms of media, which are extremely expensive, hanging banners, posters and banners attached to structures, A-frame signs, hand-made posters, signs and banners, which also are adversely affected by said weather conditions, including signs anchored to the ground which may be unatractive and potentially a visual hinderance to traffic.

SUMMARY OF THE INVENTION

It is a general object of this invention to provide a new and improved flexible display banner which is visually perceived, easily applied, and conveniently stored and transported. It is also an object of the invention to provide a visually perceived flexible display banner whereby messages may be readily changed to accomodate current information and conditions, with the ability to change many electronic-type messages via remote control.

An innovative alternative to existing conventional practices of message projections of any nature is the use of a flexible display banner for displaying a visually perceived message of any nature. The invention is lightweight, durable, easily stored and transported, and can be securely attached and adapted to structures of varying sizes, such as poles, trees, columns, guardrails, lightposts and other like structures without causing damage to said structures.

The objects of the invention are accomplished by using a pre-made flexible display banner which is constructed to either appropriately accommodate an electrical signboard, particularly that of a light emitting diode (LED) nature, or a pre-printed signboard with appropriately related indicia, which is visually perceived via a transparent panel of the containment pouch of the invention, or with a pre-printed message being a physical part of or attachment to the invention itself.

The invention is also directed to practices of search and rescue and like endeavors during or after natural disasters, including disasters of a man-made nature, whereby search and rescue endeavors will be enhanced via the application of the invention either prior to said disasters whenever a forewarning permits or during and after said disasters.

The invention is also directed to the field of traffic control, whereby vehicular traffic is not only forewarned but also alerted to unsafe, hazardous conditions or any conditions which may adversely affect the normal flow of vehicular traffic, such as construction, cleaning procedures, tree trimming procedures, or other procedures including accidents, detours, and damaged or inoperative traffic lights, whereby the signboard containment pouch housing temporary traffic lights or lights similar to dusk to dawn barricade lights, would temporarly replace inoperative traffic lights and safely direct and control traffic during the traffic control device replacement interim, thereby deferring the human endangerment factor such as the need for law enforcement representatives to physically direct traffic during said conditions.

The invention will also utilize directional and instructional messages such as "CAUTION", "YIELD?, "DETOUR" (with an arrow pointing in any of four directions), and other like messages.

The invention is also directed to the field of military training and manuevers, whereby display messages will play a major role as both directional and instructional training tools by which military personnel will learn to follow directions and instructions visually projected by various display messages, thereby enhancing the potential success of the military training manuevers.

The invention is also directed to areas of snow skiing, hiking, camping and other like sports, whereas participants will be guided, directed and instructed by display messages, relating to trails being closed, existing accidents, and other hazardous conditions so that further like incidents may be averted.

The invention is also directed to the field of science and research, whereas said invention, void of the message containment pouch, is coated or applicated with a chemical or a solution specifically configured to attract and capture insects of any specie for use in research particularly insects harmful or fatal in nature, including incidents where great numbers of humans are starving and dying with no control over human waste where insects particularly flies, reach an infestation stage and are spreading disease.

The invention is also directed to the field of international signs of language, whereas pictures of lodging, fuel, food, the prohibition of trucks, littering, parking, and other like indicia are used to convey messages of an instructional and informative nature, whereby people of all origins will understand said signs.

The invention is also directed to the high seas, whereas sea-faring vessels of any nature will benefit from the utilization of a flexible display banner by any means but particularly on masts, poles, columns, or other like structures of said vessels, enhancing communications of any nature from and among said vessels.

The invention is also directed to the personal and novel field whereby visually displayed messages of a personal and novel nature are displayed, such as "It's A Boy" or "40th Birthday" or "Bon Voyage" and to project one's favorite sporting team such as "Redskins" and "Chicago Bulls" and "UCLA" and any other like sporting teams and of a holiday or seasonal type nature, such as "4th of July" and "Merry Christmas" and "Happy Easter" and any other like holiday or seasonal type message.

The advantages of the invention over any prior art similarities are that the invention is neither hand-held, nor heavy, nor cumbersome, nor bulky, nor difficult to store and transport, nor is it adversely affected by inclement weather conditions, and it can be applied to varying size structures without causing damage to said structures. The visually displayed messages can be changed readily and in some instances by remote control. Prior art similarities are hand-held, heavy, cumbersome, bulky, difficult to store and transport, and are adversely affected by inclement weather conditions. The invention also can provide visually perceived messages on two or more sides of said banner whenever necessary.

BRIEF DESCRIPTION OF DRAWINGS

For further comprehension of the drawings, and of the objects and advantages thereof, reference will be made to the following description and accompanying drawings, schematic examples and appended claims in which the various utility and novel aspects of the invention are more particularly set forth, forming a part thereof, in which:

DESCRIPTION OF THE PREFERRED EMBODIMENTS

Figure 1:
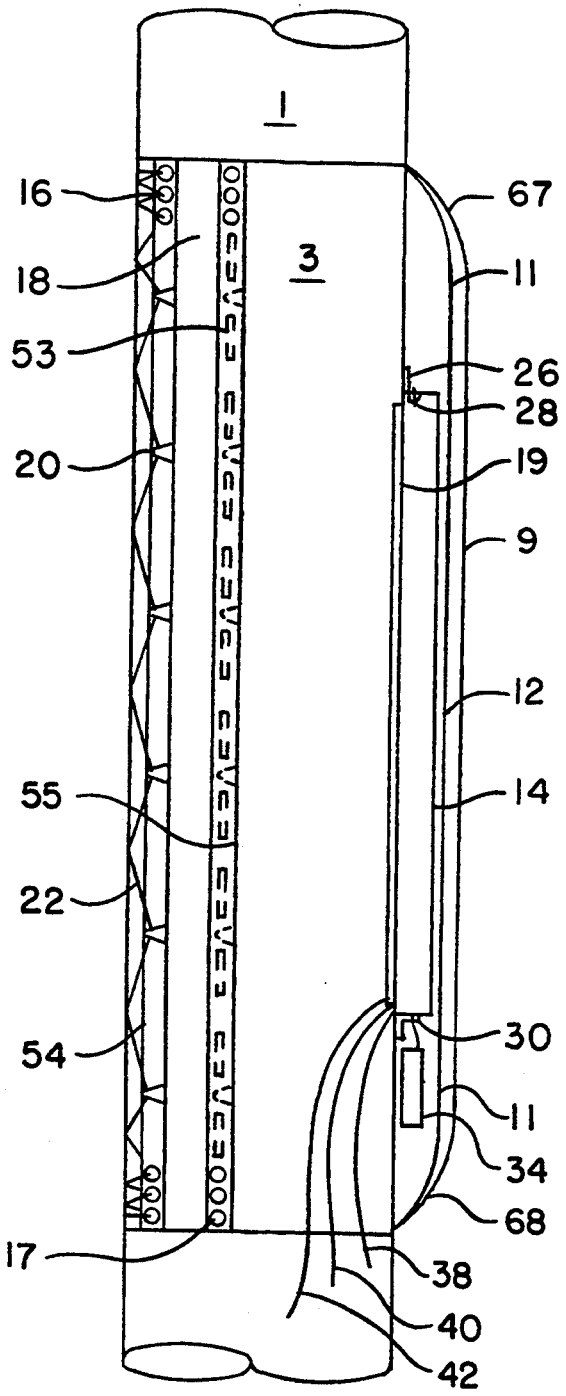
FIG. 1 is a side elevational view of the invention, with a containment pouch for housing messages, in an enveloped state encompassing a structure, showing a means of securing the invention to a structure via grommets, hooks and lacing, and two stretchable panels which will allow the invention to readily conform to odd or uneven deviations in the shape of a structure.

In FIG. 1, the flexible display banner as shown in an enveloped state encompassing a structure 1, is constructed with a flexible display banner 3 made of non-stretchable material with one of two adjustment strip flaps 55 which are a physical part of said banner 3 and becomes a strip flap 55 via a sewn seam, has a set of three grommets 17 at each end with lacing hooks 51 fixed to the underside of said flap 55, thereby being illustrated as hidden. Tabs 53, comprised of hook and loop fastener material also fixed to the underside of said flap 55, thereby also being illustrated as hidden, are used to secure said flaps 55 to said banner 3 when said flaps 55 are not in use. A particularly suitable hook and loop material is sold under the trademark VELCRO by Velcro, USA, Inc. of Manchester, Ohio. One of two stretchable panels 18 connects with one of the adjustment strip flaps 55 along the length of one side and with one of the two lacing strips 54 along the length of the other side of said panel 18 via sewn seams. The two lacing strips 54 made of non-stretchable material with a set of three grommets 16 and lacing hooks 20 secure the invention to a structure with lacing 22 via a lacing procedure beginning with a set of three grommets 16 at either end of said strips 54 and ending with said grommets 16 at the opposite end of said strips 54. The two stretchable panels 18 will allow the invention to readily adjust to structures of varying configurations and to structures larger than the invention.

The containment pouch 12, made of non-stretchable material is rectangular in shape having an upper panel 67 and a lower panel 68 and two side panels 11 made of non-stretchable material, is fixed to the flexible display banner 3 via sewn seams. The transparent display panel 9 made of clear, transparent material having a lower edge, an upper edge and two side edges is fixed to containment pouch 12, through which messages of any nature will be visually perceived, but particularly messages of an electrically operated message display signboard 14 designed to display messages of a light emitting diode composure. The signboard 14 will be inserted through retaining flap 19 rectangular in shape with an upper sewn seam, a lower sewn seam, a side sewn seam and an open side seam fixed to the inner side of said banner 3. Retaining flap 19 constitutes the rear of a pocket encompassed by containment pouch 12 and further bounded by display panel 9. The signboard 14 will be hung by an attached ring 28 from a curved hook 26, which is fixed to said banner 3, and rests upon a retention shelf 30 thereby deferring full weight of said signboard 14 upon said hook 26. An alarm 34 of any nature, but particularly one that emits a loud ringing sound similar to a fire alarm upon unauthorized tampering of said pouch 19, is inserted into pouch 12 adjacent lower panel 68. The transparent panel 9 is bordered by the side panels 11 of the containment pouch 12 which are opaque, thereby concealing the curved hook 26, the ring 28, the retention shelf 30 and the alarm 34. An alarm cord 38, an AC cord and an electrical signboard computer cord exit through the open side seam of flap 19 thereby exiting from the flexible display banner 3, allowing said cords 38, 40, 42 access to a power source.

Figure 2:
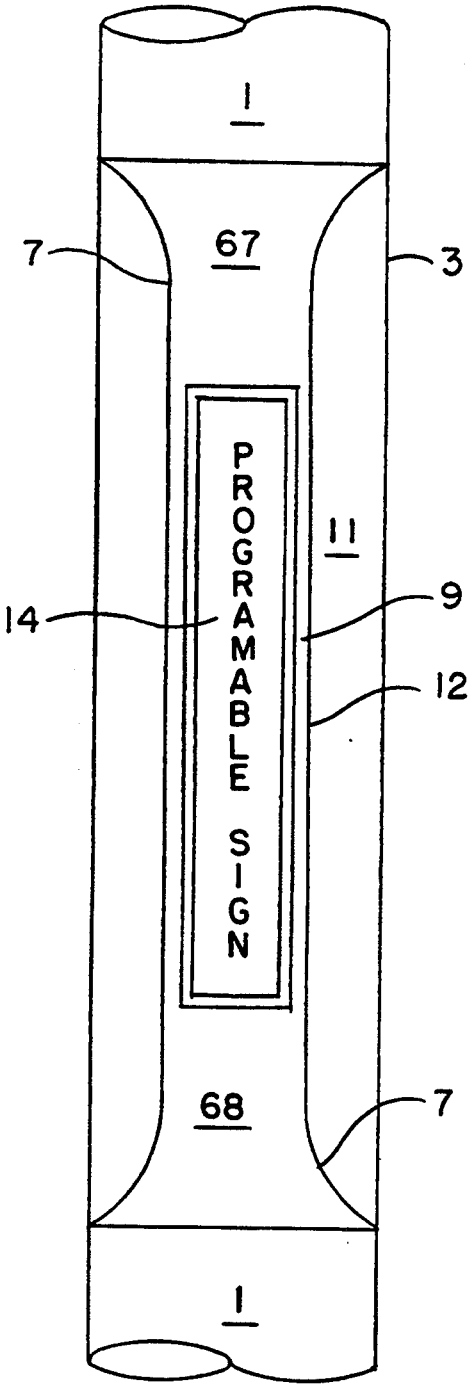
FIG. 2 is a front elevational view of the invention as shown in an enveloped state encompassing a structure showing a message display signboard, particularly one of a programmable nature, as visually perceived through a transparent panel of a containment pouch.

FIG. 2 illustrates the invention in an enveloped state encompassing a structure 1. The opaque panels 11 which conceal components of the signboard 14 are attached to transplant panel 9 via sewn seams 7. Messages projected by the signboard 14 are visually perceived through the transparent panel 9, which is bordered by and fixed to the opaque panels of containment pouch 12.

Figure 3:
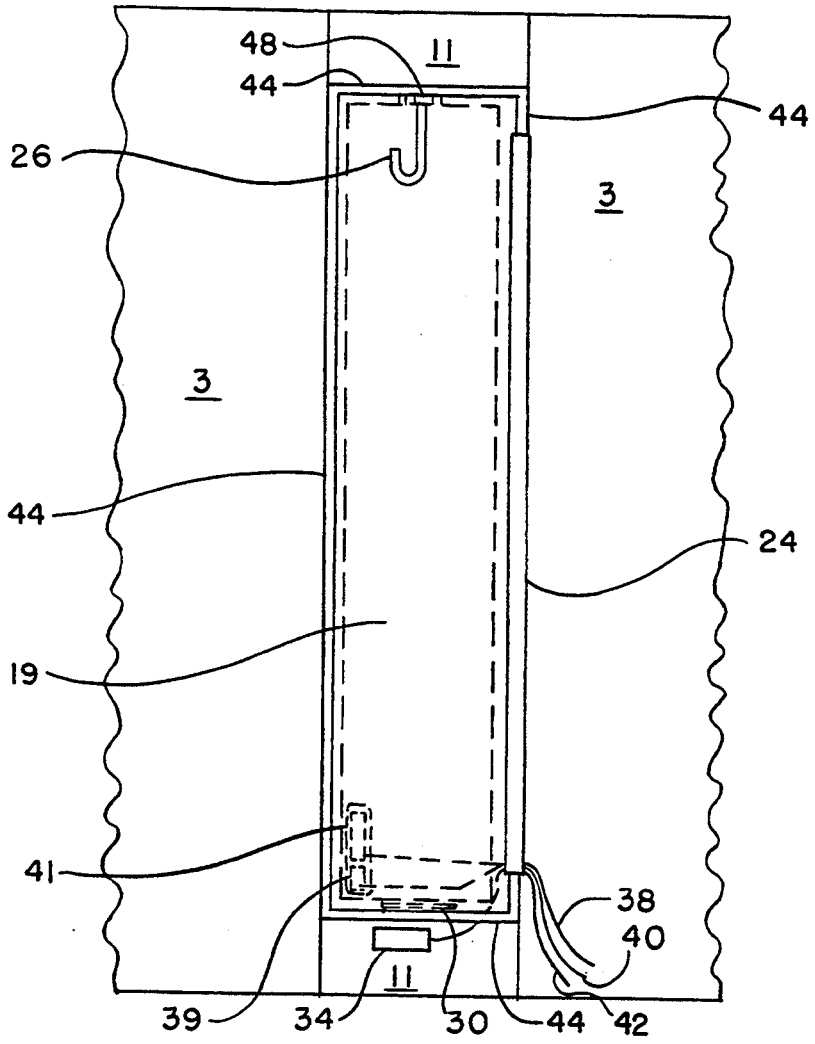
FIG. 3 is a front elevational view of a pocket as a part of the message containment pouch into which a message or a message signboard is inserted, also indicating an alarm and a means by which the pocket is fixed to the message containment pouch.

In FIG. 3, the flap 19 of the invention, with three sewn seams 44, one upper, one lower and one side, and one open side seam, is fixed to the inner side of the flexible display banner 3. The open side seam of the flap 19, through which the signboard 14 is inserted, and the opposing seam of the flexible display banner 3 have an assembly strip of VELCRO 24 along the full length of both seams, thereby allowing the flap 19 to be secured.

The signboard 14 inserted through flap 19, illustrated as hidden, hangs from the curved hook 26 which is fixed to the outer side of the flexible display banner 3 by pleater tape 48 or any other means of fastening. On the reverse side of the signboard is a square shaped receptacle 39 designed to accommodate the AC power cord 40 and an elongated rectangular shaped receptacle 41 designed to accommodate the computer cord 42.

The receptacle 39 and 41, portions of the said cords 40 and 42 are inside containment pouch 12 and are therefore illustrated as hidden, as is a portion of the alarm cord 38. The said cords 38, 40 and 42 exit through the lower part of the VELCRO strips 24, flow downward between the flexible display banner 3 and an encompassed structure, thereby becoming accessible to a power source.

Figure 4:
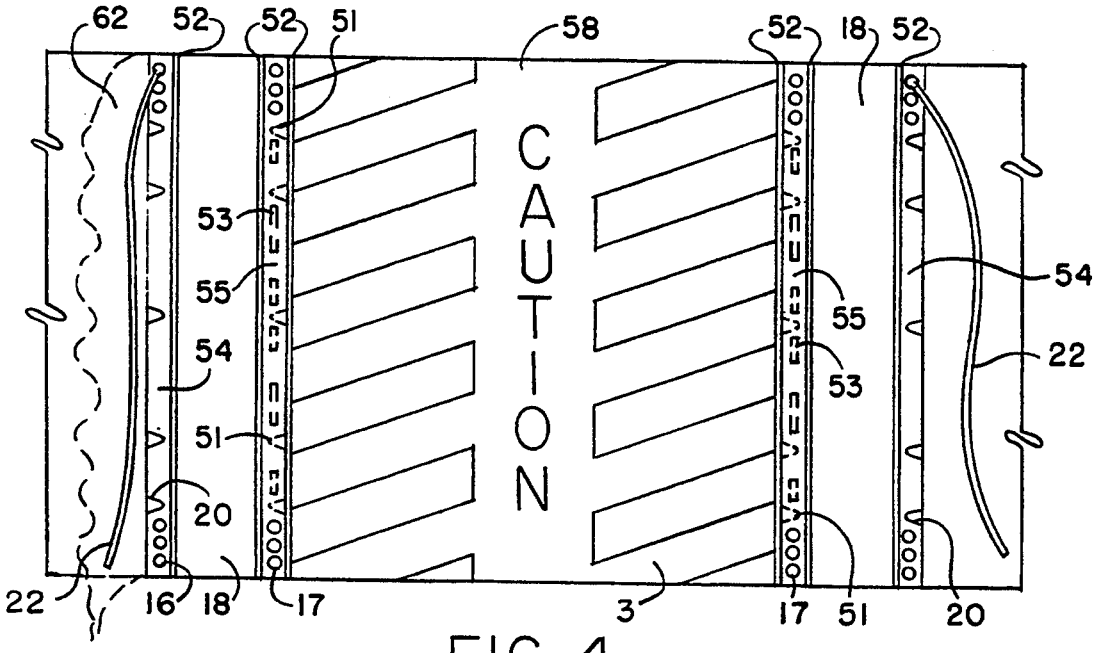
FIG. 4 is an enlarged sectional view of the invention in an unencompassed open state showing a non-stretchable panel with male snaps attached to accommodate female snaps of a closure cover, two stretchable panels, a visually perceived message, two adjustment strip-flaps with grommets, lacing hooks and velcro tabs, two lacing strips with grommets and lacing hooks, lacing, sewn seams, and a closure cover (optional) with female snaps to accommodate the male snaps fixed to the non-stretchable panel of the invention.

FIG. 4 illustrates the invention in an unencompassed state, before application to a structure. A message 58 of a pre-printed nature is a physical part of the flexible display banner 3. The lacing hooks 51 and VELCRO tab sets 53 are illustrated as hidden because they are fixed to the underside of the adjustment strip-flaps 55. The said flaps 55 will be used when said banner 3 is applied to a structure larger than said banner 3 is designed for.

An excess bib 62 prevents the structure from being seen through the lacing area between the lacing strips 54 after said banner 3 is applied to a structure. The excess bib 62 is made of non-stretchable material and measures one third the length of said banner 3. The sets of grommets 16 and the lacing hooks 20 on both lacing strips are secured via lacing 22.

Figure 5:
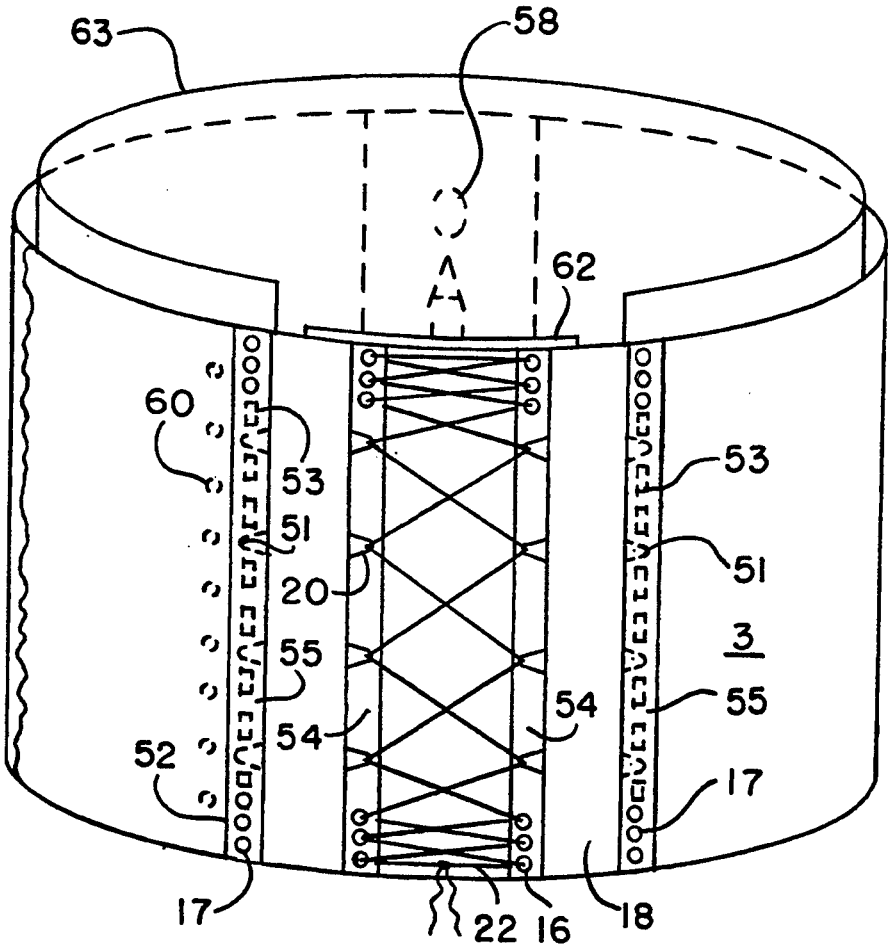
FIG. 5 is a rear perspective view of the invention in an enveloped state showing a non-stretchable panel with male snaps, both stretchable panels, both adjustment strip flaps with grommets, lacing hooks and velcro tabs, both lacing strips with grommets, and lacing hooks, sewn seams by which the lacing strips, adjustment strip flaps, stretchable panels and the non-stretchable panel are connected to each other, a closure cover with female snaps, a liner and an excess bib.

FIG. 5 illustrates the invention in an enveloped state whereas the lacing 22 secures the flexible display banner 3 to a structure when both lacing strips 54 are connected via a lacing procedure involving the grommets 16 and the lacing hooks 20. The adjustment strip-flaps 55 will be used when said banner 3 is applied to a structure smaller than the invention is designed for and will be used to secure said banner 3 to said structure via said lacing procedure. Whereas the hooks 51 and the VELCRO tab sets 53 are fixed to the underside of the adjustment strip-flaps, said hooks 51 and VELCRO tab sets 53 are illustrated as hidden. An excess bib 62, made of non-stretchable material, measures one third the length of said banner 3 and covers the area of an encompassed structure thereby concealing said structure. When not in use, the adjustment strip-flaps 55 will be secured to said banner 3 by VELCRO sets 53. The stretchable panels 18 are fixed to the adjustment strip-flaps along one edge via a sewn seam 52 and fixed to the lacing strips 54 via a sewn seam 52, and allow said banner 3 to readily conform to odd shaped and uneven structures, including structures larger than the invention is designed to fit.

A liner 63 made of non-stretchable material is fixed to the interior surface of the invention at the sewn seams of adjustment strip-flaps 55, thereby cushioning areas of a structure which will cause damage to the invention in an encompassed state.

A closure cover 64 (optional) made of non-stretchable material has female snaps 65 fixed along both edges to accommodate male snaps 66 fixed to the flexible display banner 3 the length of said banner 3 next to each adjustment strip-flap 55, whereby the closure cover 64 conceals the lacing procedure, and is designed to match any pattern of said banner 3. A message 58 is on the front side of the invention and is illustrated as hidden.

The accompanying examples indicate some structures of varying shapes, sizes and configurations to which the invention can be applied. Also indicated by the accompanying examples are adaptations to the construction of the invention which would allow the invention to further conform to structures of varying shapes, sizes and configurations. The accompanying examples also indicate the invention as applied to a mastarm, a tree and a plurality of trees.

What we claim as our invention is:

1. A display banner including:
   a) a non-stretchable panel having on an exterior surface thereof a containment pouch comprising upper, lower and two side panels, all being opaque,
   b) a transparent panel which borders on and is affixed to the containment pouch at four edges,
   c) a retaining flap attached to the interior surface of the banner along an upper, a lower and one side edge, having hook and loop fastening means along another side edge, and
   d) a message, inserted through the fastening means, hung from a hook and resting on a retention shelf so that it is visible through the transparent panel.

2. The display banner of claim 1 wherein said non-stretchable panel is fabricated of a compliant material selected from the group consisting of woven fabric, knitted fabric, unwoven fabric and flexible membranes.

3. The display banner of claim 1 wherein said message is a signboard comprised of light emitting diodes.

4. The display banner of claim 3 further comprising an alarm for preventing unauthorized tampering.

5. The display banner of claim 1 wherein said retaining flap communicates with said containment pouch.

6. The display banner of claim 13 wherein said transparent panel is bordered at least in part by the opaque panels of said containment pouch.

7. The display banner of claim 1 further comprising two adjustment strip flaps positioned adjacent opposed extremities of said banner and which are releasibly interactive to achieve snug-fitting encirclement of a support structure upon which said display banner may be mounted.

8. The display banner of claim 7 further comprising two spaced apart parallel lacing strips configured to communicate by way of an intervening lacing so as to achieve snug-fitting embracement of a support structure upon which said display banner is to be mounted, said support structure being larger in size than the display banner.

9. The display banner of claim 1 further comprising a protective liner disposed upon said interior surface.

10. The display banner of claim 1 further comprising magnet means disposed upon said interior surface.

* * * * *